US010570863B1

(12) United States Patent
Robel et al.

(10) Patent No.: US 10,570,863 B1
(45) Date of Patent: Feb. 25, 2020

(54) FUEL INJECTOR HAVING CAM-ACTUATED PLUNGER AND PLUNGER CAVITY METERING EDGE FOR VALVETRAIN NOISE SUPPRESSION

(71) Applicant: Caterpillar Inc., Deerfield, IL (US)

(72) Inventors: Wade Robel, Dunlap, IL (US); Thomas Jeffrey Crowell, Germantown Hills, IL (US); Lifeng Wang, Dunlang, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/134,170

(22) Filed: Sep. 18, 2018

(51) Int. Cl.

| | |
|---|---|
| ***F02M 55/04*** | (2006.01) |
| ***F02M 47/02*** | (2006.01) |
| ***F02M 55/00*** | (2006.01) |
| ***F01L 1/18*** | (2006.01) |

(52) U.S. Cl.
CPC ..... *F02M 55/04* (2013.01); *F01L 1/18* (2013.01); *F02M 47/027* (2013.01); *F02M 55/008* (2013.01); *F02M 2200/09* (2013.01); *F02M 2200/304* (2013.01)

(58) Field of Classification Search
CPC .... F02M 55/04; F02M 55/008; F02M 47/027; F02M 61/168; F02M 2200/09; F02M 2200/304; F01L 1/18
See application file for complete search history.

(56) References Cited

U.S. PATENT DOCUMENTS 3,486,493 A * 12/1969 Dreisin ..... F02D 1/00 123/448
4,129,255 A * 12/1978 Bader, Jr. ..... F02M 47/027 239/585.1
4,280,659 A * 7/1981 Gaal ..... F02M 57/021 239/124
4,979,674 A 12/1990 Taira et al.
5,551,398 A * 9/1996 Gibson ..... F02M 47/027 123/446
5,628,293 A 5/1997 Caterpillar
6,003,497 A * 12/1999 Rodier ..... F02M 57/024 123/506
6,427,968 B1 8/2002 Bosch
6,472,968 B1 8/2002 Stoecklein
6,505,189 B1 7/2003 Coldren et al.
6,595,189 B2 * 7/2003 Coldren ..... F02M 45/00 123/459
7,066,400 B2 6/2006 Bosch
7,258,287 B2 8/2007 Siemens
7,520,266 B2 * 4/2009 Barnes ..... F02M 57/02 123/198 D
2005/0045149 A1 * 3/2005 Udd ..... F02M 45/02 123/446

* cited by examiner

*Primary Examiner* — George C Jin

(74) *Attorney, Agent, or Firm* — Brannon Sowers & Carcraft

(57) ABSTRACT

A fuel injector includes an injector body, and a plunger movable within a plunger cavity in the injector body. The fuel injector also includes a spill valve positioned at least partially within a main fuel passage, a fill passage forming a fluid connection between the plunger cavity and the main fuel passage, and a cross passage forming a second fluid connection between the plunger cavity and the main fuel passage. The fuel injector also includes a metering edge within the plunger cavity and positioned such that the plunger passes the metering edge during pumping to the plunger for valvetrain noise suppression. A metering slot may be formed in the injector body or the plunger.

19 Claims, 3 Drawing Sheets

FUEL INJECTOR HAVING CAM-ACTUATED PLUNGER AND PLUNGER CAVITY METERING EDGE FOR VALVETRAIN NOISE SUPPRESSION

TECHNICAL FIELD

The present disclosure relates generally to noise suppression in a fuel system for an internal combustion engine, and more particularly to a fuel injector where a flow area from a plunger cavity is reduced toward the end of a plunger stroke to damp the plunger.

BACKGROUND

A wide variety of fuel systems are well known and widely used in modern internal combustion engines. Fuel may be pressurized for injection and stored in a so-called common rail that serves as a reservoir of pressurized fuel for delivery to individual fuel injectors, typically in fluid communication directly with combustion cylinders in the engine. In other designs mechanical unit injectors each include a cam-actuated plunger that pressurizes fuel for injection by one of a plurality of fuel injectors in the engine, or in some instances each plunger charges a pressure accumulator that stores pressurized fuel for less than all of the fuel injectors in the engine. Both types of systems have certain advantages and disadvantages.

In the case of mechanically actuated unit injectors the fuel system, and in particular the valvetrain, can be a significant source of undesirable engine noise. Depending upon jurisdictional requirements, engine type, operating strategies, and variations engine to engine, noise produced by the engine can range from a relatively minor annoyance to an operating property that has to be managed. Specialized parts in the nature of ground gears, viscous dampers, and expensive noise panels can be required to reduce engine noise to acceptable levels. The use of such noise management equipment can add not only expense but also complexity, weight, packaging issues and other undesired properties to the engine.

U.S. Pat. No. 6,595,189 to Coldren et al. is directed to a method of reducing noise in a mechanically actuated fuel injection system. The strategy proposed by Coldren et al. employs a flow restriction between a fuel pressurization chamber of the fuel injector and a fuel source, ostensibly for the purpose of limiting momentum of fuel exiting the fuel injector past a spill valve. Where such exiting fuel has sufficient momentum it can produce physical separation followed by rapid reengagement of cooperating engine components. Coldren et al. indicates sufficient contact force can be maintained between the various engine components to reduce the mechanical noise levels. The strategy set forth in Coldren et al. appears to have applications for certain sources of excessive engine noise, however, there is always room for improvement and advancements in this field.

SUMMARY OF THE INVENTION

In one aspect, a fuel injector includes an injector body having a longitudinal injector body axis and defining a fuel inlet, a nozzle outlet, a main fuel passage extending between the fuel inlet and the nozzle outlet, and a plunger cavity. The fuel injector further includes a plunger movable within the plunger cavity between a first end-of-stroke location at which the plunger is retracted and a second end-of-stroke location at which the plunger is advanced. The fuel injector further includes an outlet check movable within the injector body between a closed check position to block the nozzle outlet from the main fuel passage and an open check position, and a spill valve positioned at least partially within the main fuel passage and movable between a closed valve position and an open valve position. The injector body further defines a fill passage forming a first fluid connection between the plunger cavity and the main fuel passage, and a cross passage forming a second fluid connection between the plunger cavity and the main fuel passage. The fuel injector still further includes a metering edge located within the plunger cavity between the cross passage and the second end-of-stroke location, such that the plunger passes the metering edge to limit a flow area out of the plunger cavity when advanced toward the second end-of-stroke location.

In another aspect, a fuel system for an internal combustion engine includes a fuel supply, a valvetrain including a rocker arm, and a fuel injector coupled with the rocker arm. The fuel injector includes an injector body defining a fuel inlet for fluidly connecting to the fuel supply, a nozzle outlet, a main fuel passage extending between the fuel inlet and the nozzle outlet, and a plunger cavity. The injector body further defines a fill passage forming a first fluid connection between the plunger cavity and the main fuel passage, and a cross passage forming a second fluid connection between the plunger cavity and the main fuel passage. The fuel injector further includes an outlet check, a spill valve, a metering edge positioned within the plunger cavity, and a plunger. The plunger is movable within the plunger cavity from a first end-of-stroke location toward a second end-of-stroke location to pressurize a fuel for injection, and the metering edge is located between the cross passage and the second end-of-stroke location.

In still another aspect, a method of operating a fuel system for an internal combustion engine includes moving a plunger in a plunger cavity in a fuel injector from a first end-of-stroke location toward a second end-of-stroke location in response to rotation of a camshaft in a valvetrain. The method further includes closing a spill valve to block the plunger cavity from a fuel inlet in the fuel injector, such that the plunger pressurizes a fuel for injection, and opening and closing an outlet check to start spraying and then stop spraying the pressurized fuel from the fuel injector. The method further includes reducing a flow area out of the plunger cavity with the plunger prior to reaching the second end-of-stroke location, and damping the plunger by way of the reduction to the flow area so as to suppress noise production by the valvetrain.

DETAILED DESCRIPTION

Figure 1:
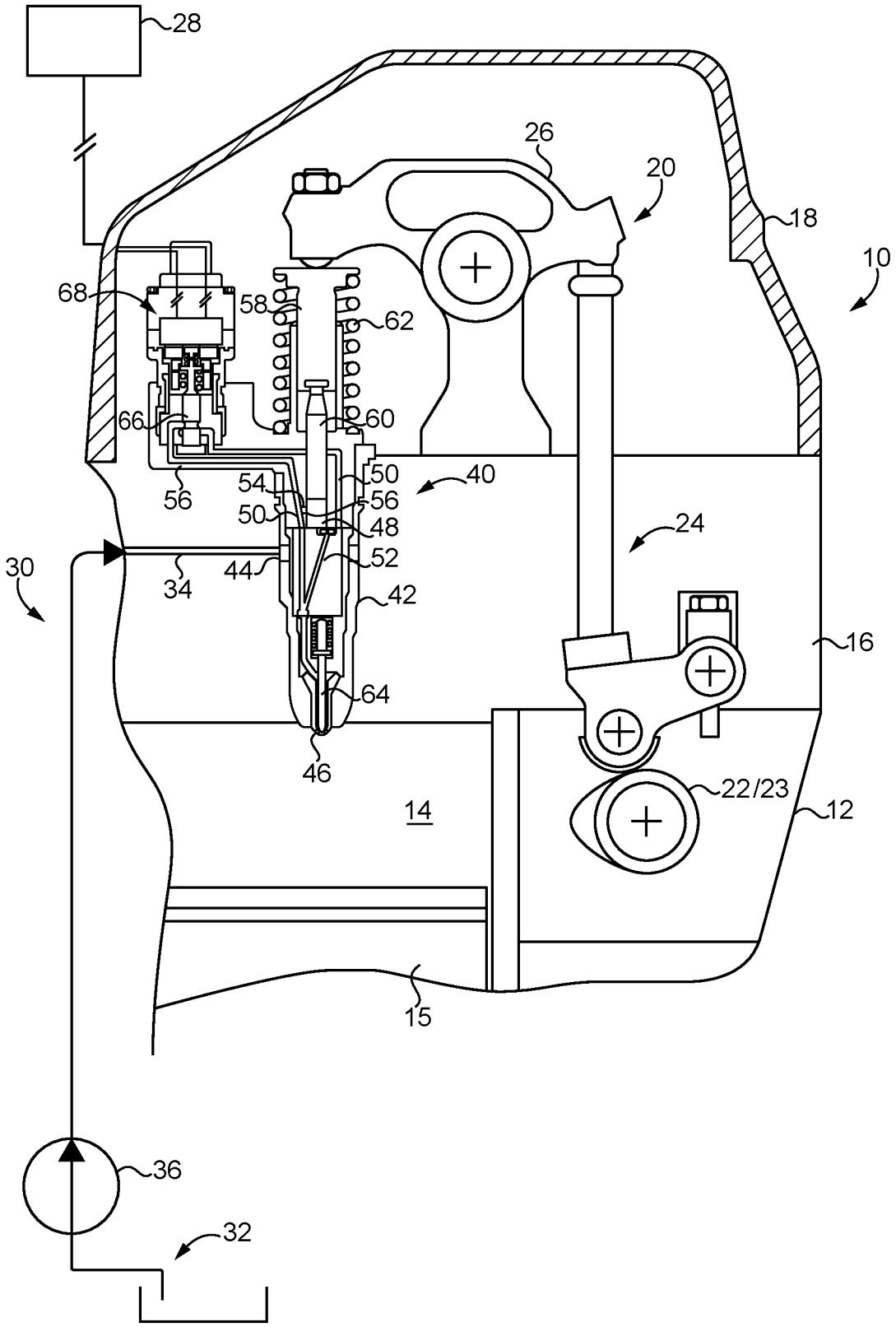
FIG. 1 is a partially sectioned side diagrammatic view of an engine system, according to one embodiment.

Referring to FIG. 1, there is shown an internal combustion engine system 10 (hereinafter "engine system 10"), according to one embodiment. Engine system 10 includes an engine housing 12 having a combustion cylinder 14 formed therein. A piston 15 is movable within cylinder 14 between a top dead center position and a bottom dead center position in a generally conventional manner. In an implementation, engine system 10 will include a plurality of cylinders formed in engine housing 12, and arranged in a V-configuration, an inline configuration, or in any other suitable arrangement, with each of the plurality of cylinders being equipped with a piston. Engine system 10 further includes an engine head 16 and a valve cover 18. A valvetrain 20 is covered at least in part with valve cover 18. Valvetrain 20 can include or be coupled with a rotatable cam 22 located upon a camshaft 23 that is operable in response to movement of piston 15 to actuate a lifter assembly 24 in a generally conventional manner. Lifter assembly 24 causes a rocker arm 26 to reciprocate back and forth to pressurize a fuel, as further discussed herein. Engine system 10 may be structured as a compression ignition diesel engine operable on a suitable fuel such as a diesel distillate fuel, biodiesel, blended fuels, or potentially even as a so-called dual fuel engine utilizing both a liquid fuel and a gaseous fuel.

Engine system 10 further includes a fuel system 30 having a fuel supply 32 and a pump 36 structured to convey fuel to an inlet passage 34 formed in engine head 16. A fuel injector 40 is supported in engine head 16 and functions to pressurize a fuel in response to operation of rocker arm 26, as further discussed herein. It will be appreciated that a plurality of rocker arms in valvetrain 20 may be provided for actuating a plurality of identical or similar fuel injectors, with each of the plurality of fuel injectors positioned to inject a fuel into a corresponding cylinder. Engine head 16 could thus include a plurality of inlet passages analogous to inlet passage 34 for supplying fuel to each of the plurality of fuel injectors. Drain passages or the like may also be provided to convey fuel not injected back to fuel supply 32 in a generally conventional manner. An electronic control unit 28 is shown in electrical control communication with fuel injector 40 for controlling functions thereof such as fuel pressurization and injection, as also further discussed herein. As will be further apparent from the following description, engine system 10 and fuel system 30 are structured for reduced noise, including reduced noise produced by valvetrain 20 during operation.

Figure 2:
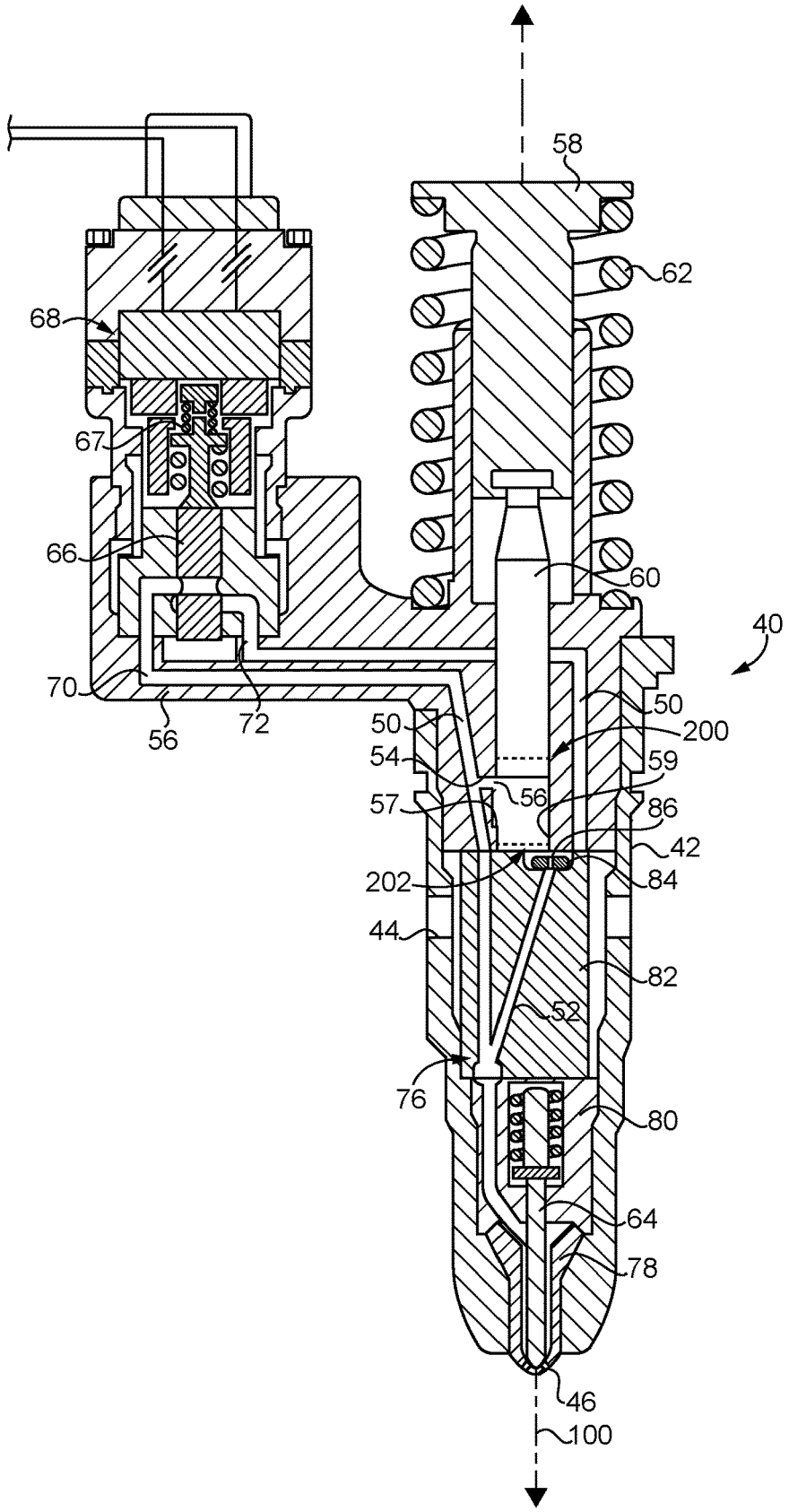
FIG. 2 is a sectioned side diagrammatic view of a fuel injector, according to one embodiment.

Fuel injector 40 includes an injector body 42 having a longitudinal injector body axis 100 and defining a fuel inlet 44, a nozzle outlet 46, a main fuel passage 50 extending between fuel inlet 44 and nozzle outlet 46, and a plunger cavity 48. Fuel inlet 44 can connect to inlet passage 34, which in turn may form a fuel supply annulus extending circumferentially around injector body 42 within engine head 16. Nozzle outlet 46 may fluidly communicate with cylinder 14 and can include a plurality of spray orifices in some embodiments, with injector body 42 extending into cylinder 14 to enable direct injection of the fuel. A tappet 58 may be coupled with injector body 42 and movable in response to movement of rocker arm 26. A return spring 62 biases tappet 58 away from injector body 42 and also biases rocker arm 26 toward rotation away from fuel injector 40, in a clockwise direction in the FIG. 1 illustration. As an alternative to the configuration depicted in FIG. 1, an overhead cam design or the like could also be used. It should also be appreciated that the term "injector body" is used herein in reference generally to elements of fuel injector 40 having fixed locations or positions, while other terms are used to refer to moving components that are thus not fixed. Referring also to FIG. 2, plunger 60 is movable within plunger cavity 48 between a first end-of-stroke location, approximately at dashed line 200 in FIG. 2, at which plunger 60 is retracted, and a second end-of-stroke location approximately at dashed line 202 in FIG. 2, at which plunger 60 is advanced. Plunger 60 can be actuated in response to rotation of cam 22/camshaft 23, and upward and downward travel of lifter assembly 24. An outlet check 64 is movable within injector body 42 between a closed check position to block nozzle outlet 46 from main fuel passage 50, and an open check position. Outlet check 64 can include a known spring-biased needle check opening in response to hydraulic pressure within injector body 42 and in main fuel passage 50 that overcomes a closing biasing force of a check biasing spring (not numbered). In other implementations outlet check 64 could be directly controlled, with fuel injector 40 including an electrical injection control valve structured to vary a closing hydraulic pressure on a closing hydraulic surface of the direct operated outlet check. A spill valve 66 is positioned at least partially within main fuel passage 50 and movable between a closed valve position and an open valve position. An electrical spill valve actuator 68 changes its electrical energy state in response to a control signal, such as a control current, from electronic control unit 28 to move spill valve 66 between the open valve position and the closed valve position.

Spill valve 66 is positioned fluidly between a fuel passage segment 70 that extends to nozzle outlet 46, and another fuel passage segment 72 that extends to fuel inlet 44. Spill valve 66 may be spring-biased open to fluidly connect fuel passage segment 70 to fuel passage segment 72, such that so long as spill valve actuator 68 is in a first electrical energy state, such as a deenergized state, movement of plunger 60 between the first end-of-stroke location and the second end-of-stroke location pumps fuel into and out of plunger cavity 48 without substantially affecting pressure of the pumped fuel nor initiating fuel injection. In response to an appropriate control signal, from electronic control unit 28, spill valve 66 is moved to the closed valve position to block plunger cavity 48 from fuel inlet 44, to pressurize fuel for injection. When the pressure of fuel within plunger cavity 48 is sufficient, outlet check 64 is urged open by the hydraulic pressure to enable fuel to spray out of nozzle outlet 46 into cylinder 14. Outlet check 64 could be actuated by way of the force of a biasing spring, or by a combination of hydraulic pressure and force of a biasing spring, for example. When spill valve electrical actuator 68 is once again deenergized, or otherwise its electrical energy state is appropriately changed, spill valve 66 can return toward an open position, a downward position in the FIG. 2 illustration, to reestablish fluid communication between fuel passage segment 70 and fuel passage segment 72. Reopening of the fluid communication can result in outlet check 64 returning to its closed check position to end fuel injection and commence of depressurizing of plunger cavity 48. An end of fuel injection is commonly timed such that spill valve 66 is opened prior to a point in time at which plunger 60 has reached the second end-of-stroke location. When spill valve 66 opens, the relatively rapid depressurization of plunger cavity 48 can cause plunger 60 to accelerate such that tappet 58 comes out of contact with rocker arm 26 and/or components come out of contact with one another elsewhere in valvetrain 20 or even in an associated engine geartrain, or still other undesired phenomena occur. Separation of contact between components ordinarily maintained in contact with one another by way of relatively strong spring biasing or other forces, and reestablishment of that contact, in a dynamic and relatively rapidly rotating and reciprocating valvetrain, generates mechanical strain, vibration, and impacts that can produce significant noise. Such noise tends to be challenging and/or expensive to manage according to known techniques.

Injector body 42 further defines a fill passage 52 forming a first fluid connection between plunger cavity 48 and main fuel passage 50, and a cross passage 54 forming a second fluid connection between plunger cavity 48 and main fuel passage 50. A metering edge 56 is located within plunger cavity 48 between cross passage 50 and the second end-of-stroke location, such that plunger 60 passes metering edge 56 to limit a flow area out of plunger cavity 48 when plunger 60 is advanced toward the second end-of-stroke location, thereby damping plunger toward an end of a pumping stroke. Fuel injector 40 may further have a metering slot 57 formed in one of injector body 42 or plunger 60 and fluidly connected to each of plunger cavity 48 and cross passage 54. Metering slot 57 may be formed in a wall 59 of plunger cavity 48, in the illustrated embodiment, and extends axially from metering edge 56 toward the second end-of-stroke location. It will be understood from FIG. 2 that metering slot 57 is blocked from plunger cavity 48 by plunger 60 at the second end-of-stroke location in the illustrated embodiment, such that plunger 60 reduces a flow area out of plunger cavity 48. In other embodiments, metering slot 57 could extend all the way to the second end-of-stroke location, or be formed in plunger 60 itself as further discussed herein. Metering edge 56 can form an edge of a fuel annulus that extends circumferentially around plunger cavity 48 within wall 59 in certain embodiments. In one implementation metering edge 56 does not extend circumferentially around plunger cavity 48 and instead is formed by or adjacent to the opening of cross passage 54 to plunger cavity 48.

Fuel injector 40 may also include a flow restrictor 84 positioned at least partially within fill passage 52 and movable between a first restrictor position at which a flow area of fill passage 52 is relatively greater, and a second restrictor position at which a flow area of fill passage 52 is relatively less. Flow restrictor 84 may have a flow throttling orifice 86 formed therein. Injector body 42 may also include a valve stack 76 having a plurality of valve stack components including a first stack component 78 that forms a tip (not numbered) of injector body 42, a second valve stack component 80 that receives and guides outlet check 64, and a third valve stack component 82. Fill passage 52 may be formed at least partially within valve stack component 82. Injector body 42 also includes at least one other body piece 83 that abuts valve stack component 82 and supports spill valve 66 and related components in a so-called sidecar arrangement, however, the present disclosure is not thereby limited. Flow restrictor 84 may include a disc plate 84 trapped between a first one of the plurality of valve stack components such as valve stack component 82 and a second one of the plurality of valve stack components such as body piece 83. It can thus be understood that flow restrictor 84 is movable when plunger 60 is moved toward the first end-of-stroke location in an intake stroke to enable fuel to flow from main fuel passage 50 into fill passage 52 and thenceforth into plunger cavity 48. During the intake stroke flow restrictor 84 may move to the first restrictor position that includes a first stop position in contact with body piece 83. During a pressurization stroke of plunger 60, as plunger 60 is advanced toward the second end-of-stroke location, flow restrictor 84 may be urged back to a second stop position contacting valve stack component 82.

Figure 3:
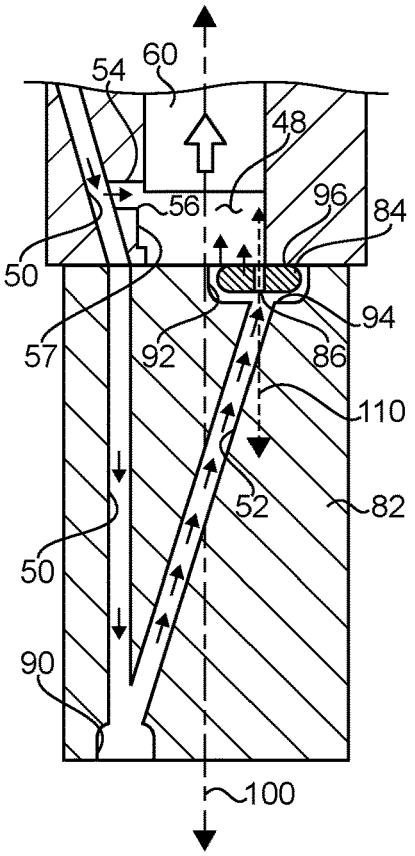
FIG. 3 is a sectioned side diagrammatic view of a portion of the fuel injector of FIG. 2 in one configuration.
Figure 4:
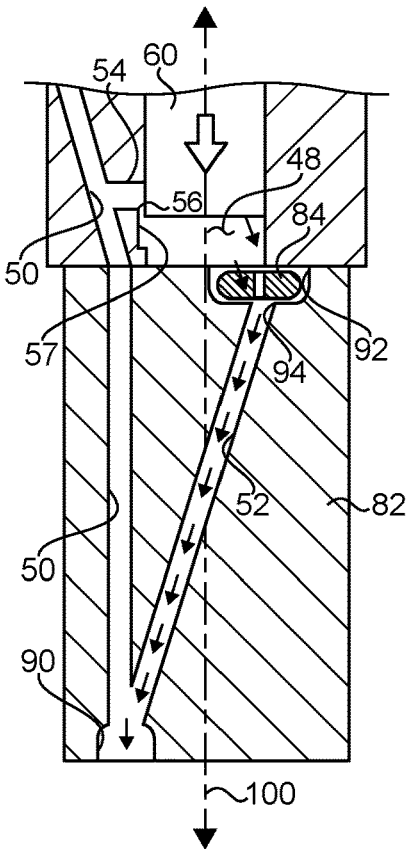
FIG. 4 is a sectioned side diagrammatic view of the portion of the fuel injector in a second configuration.

Referring also now to FIGS. 3 and 4, valve stack component 82 may have a well 92 formed therein, and a valve seat 94 within well 92 and extending circumferentially around fill passage 52. Flow restrictor 84 may further define a disc plate center axis 110 that is radially offset from longitudinal injector body axis 100. A junction 90 is formed between fill passage 52 and main fuel passage 50 and may have a bathtub configuration in some embodiments. It should also be appreciated that flow restrictor 84 might not have a flow throttling orifice at all in some instances and is thus understood as a check valve.

In FIG. 3, plunger 60 is shown approximately as it might appear during an intake stroke moving generally upward through plunger cavity 48 such that plunger 60 is clear of metering edge 56 and fuel can flow through cross passage 54 into plunger cavity 48. In FIG. 4 plunger 60 is shown as it might appear during a pressurization stroke and has moved downward to pass metering edge 56 as plunger 60 is advanced toward the second end-of-stroke location. It should be appreciated that metering edge 56 could include a relatively sharp, right-angled transition, or a more gradual transition. Spill valve 66 might be opened approximately at the timing at which plunger 60 is at metering edge 56 in a pressurization stroke. It can be further seen from the illustrations that metering slot 57 is fluidly connected to each of plunger cavity 48 and cross passage 54. When plunger 60 is at or closer to the position depicted in FIG. 3 cross passage 54 is directly fluidly connected to plunger cavity 48. When plunger 60 has moved downward to pass metering edge 56 plunger cavity 48 is fluidly connected to cross passage 54 only by way of metering slot 57, up until a point in time at which plunger 60 advances further downward beyond an axial extent of metering slot 57. As noted above, however, while plunger 60 may block fluid connection between plunger cavity 48 and cross passage 54 when plunger 60 is at the second end-of-stroke location, in other instances some fluid connection between plunger cavity 48 and cross passage 54 could exist even when plunger 60 is at the second end-of-stroke location.

The use of flow throttling orifice 86 and the capability to vary both an axial location of metering edge 56 as well as an axial length, a radial depth, a shape, or a circumferential extent of metering slot 57 are all factors that can be exploited to obtain desired operation and performance by enabling plunger bore pressure to be tunable for different engine timing states. Reduced parasitics may also be observed in comparison to certain known designs, as damping is attained without producing especially high pressures within plunger cavity 48 after injection has ended. Moreover, the geometry of metering slot 57, metering edge 56, and cross passage 54 may depend in part upon the techniques used to form the various features, such as using a drill, wire electrostatic discharge machining (EDM), a biscuit cutter or still another technique. A position of plunger 60 between the first end-of-stroke location and the second end-of-stroke location may be coupled to a position of piston 15 in engine system 10. Metering edge 56 may be located at a plunger position within plunger cavity 48 that corresponds to about 20 degrees to about 30 degrees from a top dead center position of piston 15. In other words, as plunger 60 travels downward in a pressurization stroke, at the point in time at which metering edge and plunger 60 are at the same axial location, piston 15 may be about 20 degrees to about 30 degrees from a top dead center position. In a practical implementation strategy, when plunger 60 moves down in a pressurization stroke and spill valve 66 is operated to enable injection of fuel, plunger 60 might reach an axial location of metering edge 56 at about 25 degrees after a top dead center position of piston 15 in a compression stroke in a conventional four-stroke engine cycle. The term "about" can be understood herein in the context of conventional rounding to a consistent number of significant digits. Accordingly, "about 20" means from 15 to 24, and so on.

Figure 5:
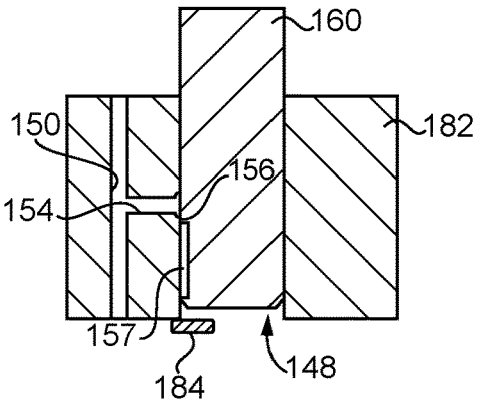
FIG. 5 is a sectioned side diagrammatic view of a portion of a fuel injector according to another embodiment.
Figure 6:
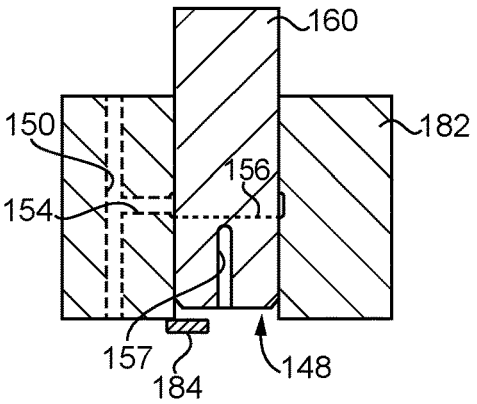
FIG. 6 is another sectioned side diagrammatic view of the fuel injector of FIG. 5.

Referring now to FIG. 5 and FIG. 6, there are showed sectioned views through a portion of a fuel injector according to another embodiment. As stated above, a metering slot in a fuel injector according to the present disclosure might be located in a plunger instead of, or potentially in addition to, in the injector body itself. In FIGS. 5 and 6, a main fuel passage 150 is formed in an injector body/valve stack component 182 and connects to a plunger cavity 148 by way of a cross passage 154. A flow restrictor 184 will be understood to be positioned at least partially within a fill passage (not shown) extending from cross passage 150 to plunger cavity 148 and is structured as a check valve in the illustrated embodiment. A flow throttling orifice could be formed in flow restrictor 184 in other embodiments. A metering edge 156 is formed by valve stack component 182. A metering slot 157 is shown formed in a plunger 160 in a side view in FIG. 5, and again in FIG. 5 rotated approximately 90 degrees from the perspective of FIG. 5. It should be appreciated that the configuration depicted in FIGS. 5 and 6 could provide functionality similar to that of the foregoing embodiments, and could be used in fuel injector 40, fuel system 30, and engine system 10. Hence, the description of the foregoing embodiments can be understood to generally refer also to the embodiment of FIGS. 5 and 6. In the embodiment of FIGS. 5 and 6, metering edge 156 will typically extend circumferentially around plunger cavity 148 and includes the bottom edge of a fuel annulus.

INDUSTRIAL APPLICABILITY

Referring to the drawings generally, operating fuel system 30 for an internal combustion engine system 10 can include moving plunger 60 in plunger cavity 48 in fuel injector 40 from the first end-of-stroke location toward the second end-of-stroke location in response to rotation of cam 22/camshaft 23 in valvetrain 20. Plunger 60 will have previously been moved in an opposite direction to draw fuel into plunger cavity 48, or be urged upward in response to incoming fuel pressure, in the manner discussed herein. When fuel pressurization is desired, spill valve 66 is closed to block plunger cavity 48 from fuel inlet 44 in fuel injector 40, such that plunger 60 pressurizes the fuel for injection in a downward pressurization stroke. Outlet check 64 may be opened and closed to start spraying and then stop spraying the pressurized fuel from fuel injector 40, namely, through one or more spray orifices of nozzle outlet 46.

As plunger 60 advances through plunger cavity 48, and then reaches and passes metering edge 56 a flow area out of plunger cavity 48 is reduced by plunger 60 occluding, at least partially, cross passage 54. As noted above, spill valve 66 is opened approximately at the time at which plunger 60 reaches metering edge 56. Moving of plunger 60 beyond metering edge 56 in the fuel pressurization stroke is damped by way of the reduction to the flow area. Damping of plunger 60 limits an acceleration of plunger 60 that might otherwise occur when spill valve 66 is opened and plunger cavity 48 begins to rapidly depressurize. As discussed above, opening a spill valve can result in a sudden drop in resistance of a fuel pressurization plunger to travel, resulting in components coming out of contact with one another or other problems that produce valvetrain noise. Reducing the flow area at the appropriate timing as discussed herein suppresses noise production by valvetrain 20.

As also mentioned above there are certain features of fuel injector 40 that could be varied or tuned to obtain a desired operation or performance. In one practical implementation strategy, cross passage 54 has a cross passage flow area and flow throttling orifice 86 has an orifice flow area that is less than the cross passage flow area. A flow area defined by metering slot 57 (a "first flow area") might be similar to a flow area defined by flow throttling orifice 86 (a "second flow area"), or the first flow area might be greater than the second flow area, or less than the second flow area, depending upon desired operating properties or performance. In embodiments where metering slot 57 provides fluid communication between plunger cavity 48 and cross passage 54, advancing plunger 60 past metering edge 57 can eventually produce a state where plunger cavity 48 is not fluidly connected to cross passage 54. At least for a portion of a travel distance of plunger 60 between the first end-of-stroke location and the second end-of-stroke location only metering slot 57 fluidly connects plunger cavity 48 to cross passage 54. As plunger 60 reaches the second end-of-stroke location and begins to return toward the first end-of-stroke location, plunger cavity 48 may be filled by way of fill passage 52 during moving plunger 60 from the second end-of-stroke location back toward the first end-of-stroke location. Pressurized fuel from plunger cavity 48 is conveyed to nozzle outlet 46 by way of each of cross passage 54 and flow throttling orifice 86 in flow restrictor 84 in embodiments where a flow throttling orifice is used. In other embodiments where a flow throttling orifice is not used, flow restrictor 84 can function as a check valve, opened when plunger 60 is moved toward the first end-of-stroke location, and closed in response to moving plunger 60 toward the second end-of-stroke location.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an injector body having a longitudinal injector body axis and defining a fuel inlet, a nozzle outlet, a main fuel passage extending between the fuel inlet and the nozzle outlet, and a plunger cavity;

a plunger movable within the plunger cavity between a first end-of-stroke location at which the plunger is retracted and a second end-of-stroke location at which the plunger is advanced;

an outlet check movable within the injector body between a closed check position to block the nozzle outlet from the main fuel passage and an open check position;

a spill valve positioned at least partially within the main fuel passage and movable between a closed valve position and an open valve position;

the injector body further defining a fill passage forming a first fluid connection between the plunger cavity and the main fuel passage, and a cross passage forming a second fluid connection between the plunger cavity and the main fuel passage; and a metering edge located within the plunger cavity between the cross passage and the second end-of-stroke location, such that the plunger passes the metering edge to limit a flow area out of the plunger cavity when advanced toward the second end-of-stroke location.

2. The fuel injector of claim 1 further comprising a metering slot formed in one of the injector body or the plunger and fluidly connected to each of the plunger cavity and the cross passage.

3. The fuel injector of claim 2 wherein the metering slot is formed in a wall of the plunger cavity and extends axially from the metering edge toward the second end-of-stroke location.

4. The fuel injector of claim 3 wherein the metering slot is blocked from the plunger cavity by the plunger at the second end-of-stroke location.

5. The fuel injector of claim 2 wherein the metering slot is formed in the plunger.

6. The fuel injector of claim 2 further comprising a flow restrictor positioned at least partially within the fill passage and movable between a first restrictor position at which a flow area of the fill passage is relatively greater, and a second restrictor position at which a flow area of the fill passage is relatively less.

7. The fuel injector of claim 6 wherein the injector body further includes a valve stack having a plurality of valve stack components, and wherein the flow restrictor includes a disc plate having a flow throttling orifice formed therein, and the flow restrictor is trapped between a first one of the plurality of valve stack components and a second one of the plurality of valve stack components.

8. The fuel injector of claim 7 wherein the disc plate defines a disc plate center axis that is radially offset from the longitudinal injector body axis.

9. The fuel injector of claim 6 where the flow restrictor includes a check valve.

10. A fuel system for an internal combustion engine comprising:

a fuel supply;

a valve train including a rocker arm;

a fuel injector coupled with the rocker arm and including an injector body defining a fuel inlet for fluidly connecting to the fuel supply, a nozzle outlet, a main fuel passage extending between the fuel inlet and the nozzle outlet, and a plunger cavity;

the injector body further defining a fill passage forming a first fluid connection between the plunger cavity and the main fuel passage, and a cross passage forming a second fluid connection between the plunger cavity and the main fuel passage;

the fuel injector further including an outlet check, a spill valve, a metering edge positioned within the plunger cavity, and a plunger; and the plunger being movable within the plunger cavity from a first end-of-stroke location toward a second end-of-stroke location to pressurize a fuel for injection, and the metering edge being located between the cross passage and the second end-of-stroke location.

11. The fuel system of claim 10 further comprising a movable flow restrictor positioned at least partially within the fill passage.

12. The fuel system of claim 11 wherein the flow restrictor has a flow throttling orifice formed therein.

13. The fuel system of claim 12 wherein a flow area of the flow throttling orifice is less than a flow area of the cross passage.

14. The fuel system of claim 12 wherein the fuel injector further includes a metering slot formed in one of the injector body or the plunger and fluidly connected to each of the plunger cavity and the cross passage.

15. The fuel system of claim 10 wherein the fuel injector further includes a metering slot formed in one of the injector body or the plunger and fluidly connected to each of the plunger cavity and the cross passage.

16. The fuel system of claim 10 wherein a position of the plunger between the first end-of-stroke location and the second end-of-stroke location is coupled to a position of a piston in the internal combustion engine, and wherein the metering edge is located at a plunger position within the plunger cavity that corresponds to about 20 degrees to about 30 degrees from a top dead center position of the piston.

17. A method of operating a fuel system for an internal combustion engine comprising: moving a plunger in a plunger cavity in a fuel injector from a first end-of- stroke location toward a second end-of-stroke location in response to rotation of a camshaft in a valvetrain; closing a spill valve to block the plunger cavity from a fuel inlet in the fuel injector, such that the plunger pressurizes a fuel for injection; opening and closing an outlet check to start spraying and then stop spraying the pressurized fuel from the fuel injector; reducing a flow area out of the plunger cavity with the plunger prior to reaching the second end-of-stroke location; and damping the plunger by way of the reduction to the flow area so as to suppress noise production by the valvetrain wherein the reducing of the flow area out of the plunger cavity includes advancing the plunger past a metering edge within the plunger cavity, such that only a metering slot formed in one of an injector body of the fuel injector or the plunger fluidly connects the plunger cavity to the cross passage.

18. The method of claim 17 further comprising moving the plunger from the second end-of-stroke location back toward the first end-of-stroke location and filling the plunger cavity by way of a fill passage during the moving of the plunger from the second end-of-stroke location back toward the first end-of-stroke location.

19. The method of claim 18 further comprising conveying the pressurized fuel from the plunger cavity to the nozzle outlet by way of each of the cross passage and a flow throttling orifice formed in a flow restrictor positioned at least partially within the fill passage.

* * * * *